United States Patent [19]

Corbin

[11] Patent Number: 4,527,374

[45] Date of Patent: Jul. 9, 1985

[54] THREE-TAB SHINGLE WITH STAGGERED BUTT EDGE FEATURE

[75] Inventor: Raymond L. R. Corbin, Littleton, Colo.

[73] Assignee: Manville Service Corp., Denver, Colo.

[21] Appl. No.: 109,378

[22] Filed: Jan. 3, 1980

[51] Int. Cl.[3] ..... E04D 1/26

[52] U.S. Cl. ..... 52/557; 50/559

[58] Field of Search ..... 52/314, 105, 554–559

[56] References Cited

U.S. PATENT DOCUMENTS

| | | | |
|---|---|---|---|
| De. 81,200 | 5/1930 | Naterman | 52/554 |
| 1,326,899 | 1/1920 | Abraham | 52/559 |
| 1,584,343 | 5/1926 | Abraham | 52/557 |
| 1,732,403 | 10/1929 | Harris | 52/559 |
| 1,843,370 | 2/1932 | Overbury | 52/557 |
| 2,027,029 | 1/1936 | Eckert | 52/105 |
| 2,171,010 | 8/1939 | Schuetz | 52/559 |
| 2,205,679 | 6/1940 | Ames | 52/554 |
| 2,487,593 | 11/1949 | Rowe | 52/557 |
| 2,687,701 | 8/1954 | Abraham | 52/554 |
| 3,377,761 | 4/1968 | Skelton | 52/554 |
| 3,919,823 | 11/1975 | Bradley | 52/557 |

OTHER PUBLICATIONS

Sweet's Catalog File, 7.7Jo, pp. 1, 3, 7, last page, 1979, Litho date.

*Primary Examiner*—John E. Murtagh

*Attorney, Agent, or Firm*—John D. Lister; Cornelius P. Quinn; Gregory W. O'Connor

[57] ABSTRACT

The disclosure relates to the field of composition shingles and in particular the types of shingle known as strip or tab shingles. Heretofore shingles having nonuniform random or jagged butt edges have relied on locating indicia on the upper covered portions of the leading and trailing edges thereof, or on the upper edge of the overall shingle, to aid in positioning these shingles relative to one another on a roof deck. Tab shingles have been able to eliminate at least some of the locating indicia in these areas by relying on uniformly sized and positioned slot cutouts to locate the uniform butt edges of the overlapping shingle relative to the shingle being overlapped. The present shingle includes at least one slot dividing the butt edge into two tabs. The lower edge of the tabs corresponding to a portion of the butt edge of the shingle include specifically shaped locating edges. These locating edges contribute to the jagged nonuniform appearance of the shingle. These edges are used in conjunction with slot cutouts and notches along the leading and trailing edge of the butt portion to determine proper offset alignment and butt edge exposure.

8 Claims, 4 Drawing Figures

THREE-TAB SHINGLE WITH STAGGERED BUTT EDGE FEATURE

TECHNICAL FIELD

This invention relates to a shingle used for residential roof construciton, and in particular to shingles made with a flexible felt foundation which has been saturated or coated with a waterproof substance such as asphalt or the like, and provided with a weather surface of mineral granules embedded on the upper surface thereof. Such shingles are generally rectangular shape in the plan view and are combined with other substantially identical shingles in overlapping relationship to cover a sloping roof deck. The shingles of the type disclosed can fall into two general categories. The first of these categories is the so-called strip shingle having an exposed or butt portion with a generally uninterrupted weather surface extending from a leading edge to a trailing edge thereof. The butt edge defined on the lower edge of the butt portion may include some certain aesthetic features, for example, a jagged edge to simulate wood shakes, thatch, etc., or may have a repeating geometric pattern along the lower edge thereof to simulate slate, tile, etc. The other general category of shingle of the type disclosed is the tab shingle. The tab shingle is similar to the strip shingle but has the addition of slot cutouts usually spaced at uniform intervals across the butt portion and extending vertically substantially fully across the exposed butt portion upwardly from the butt edge thereof. These slot cutouts define tabs which, when combined with other tab shingles, simulate the regular pattern typical of, for example, a slate covered roof.

BACKGROUND OF THE PRIOR ART

Strip shingles of the known type include certain random butt edge features which impart a desirable aesthetic appeal to a roof covered with a plurality of such shingles. One example of such a strip shingle is shown in U.S. Pat. No. 2,205,679. This patent shows a composition shingle having a distinctive butt edge comprised of seven linear butt edge features. Each of these butt edge features is set apart from adjacent butt edge features by differing in vertical height or slope from that of adjacent butt edge features.

Illustrating the tab shingle which includes vertical slot cutouts defining a plurality of tabs in each shingle is U.S. Pat. No. 2,348,223. This patent discloses a classic three-tab shingle. Each of the tabs is of substantially equal length, this length being defined by the two vertically extending slot cutouts which divide the shingle into the three tabs. Of particular note is the use of the vertical slot cutouts to aid in positioning each subsequent course of shingles relative to one another on a roof deck. The butt edge of shingles in each subsequent course is aligned so as to be tangent to the upper end of each slot cutout. This alignment assures a uniform degree of exposure of each tab on the roof deck. Also, the slot cutouts permit the workman to apply the shingle with substantially uniform alignment offset wherein the slot cutout of shingles in a subsequent course is positioned so as to bisect the tabs of the immediately preceding course. This alignment offset produces a pleasing aesthetic effect and breaks up the vertical pattern which would be created if each slot cutout were aligned with the just preceding slot cutout. Also, by offsetting the cutouts there is a reduced chance of leakage of for example wind-driven rain passing through one slot cutout to the juncture between the headlap portions of adjacent shingles in the immediately preceding course of shingles.

A composition shingle having features of a tab shingle, as well as having a nonuniform or random butt edge configuration, is illustrated by U.S. Pat. No. 2,199,760. The shingle disclosed therein has a series of butt edge features separated by slot cutouts, these cutouts being spaced at random distances along the length of the shingle. The tabs defined by these cutouts has a butt edge portion varying in length, width and contour. In the case of another embodiment, the tabs vary in length as well as mineral granule coloration, at least along the lower fraction of the butt portion. On this shingle certain alignment aids are provided on the sides or edges of the headlap portion thereof. The alignment feature comprises a finger-like protrusion on the leading edge at the headlap portion and a corresponding, negatively shaped slot or indentation on the trailing edge. These protrusions and slots are provided by a known manner at the time the shingles are cut from a continuous roll of composition material. Also, along the upper edge of the shingle (and hence the upper edge of the headlap portion) there is a triangular shaped notch defining the longitudinal center of the shingle. When shingles of this type are applied to a roof deck, the protrusion on the leading edge and the indentation on the trailing edge are aligned with the upper edge of the shingle in the immediately preceding course of shingles. This vertical alignment provides proper and uniform exposure of the random tabs of the shingle. Proper alignment offset of the shingles relative to the immediately preceding course of shingles is assured by aligning the leading edge, for example, with the triangular shaped notch on the upper edge of the subjacent shingle in the immediately preceding course of shingles. Each subsequent shingle in the course of shingles being applied is aligned with the immediately preceding shingle by inserting the finger-like protrusion in the leading edge thereof into the indentation of the trailing edge of the immediately preceding shingle.

Another rectangular shingle known to Applicant, and marketed by Johns-Manville Corporation under the Trademark RAMPART, has a butt edge configuration similar to that of the shingle illustrated in U.S. Pat. No. 2,205,679, and utilizes a stepped leading and trailing edge to provide indicia for proper and consistent exposure. In this alignment system, the leading edge of each shingle consists of two linear portions offset from one another by a quarter-inch step. This step occurs about five inches from the top edge of the shingle. The trailing edge comprises a similar configuration but wherein the quarter-inch step defines a notch along the top five inches of the trailing edge. The step in the leading edge fits into the notch on the trailing edge of the next succeeding shingle.

U.S. Pat. No. 3,919,823 discloses a strip shingle with a butt edge configuration simulating the appearance of wood shingles. A knife slit provided to the right of the leftmost butt edge feature permits the thus defined overlap tab to be placed over the trailing edge of the just preceding shingle in the course of shingles. This creates a double thick butt portion. Conventional alignment features are provided along the leading and trailing edges of the disclosed shingle.

Thus, the prior art shingles comprised two apparently mutually exclusive alignment concepts. In the case of a random butt edge featured shingle, alignment features in or on the edges of the headlap portion were required in order to assure a proper, aesthetically pleasing and properly functioning shingled roof. A tab shingle, having uniform butt edge features, utilized the slot cutouts and the uniform and predictable butt edge to assure proper and uniform exposure. However, in certain critical applications, even the tab shingle required indicia in the headlap portion to assure precise alignment offset.

BRIEF SUMMARY OF THE INVENTION

It is an object of the present invention to provide an improved shingle of generally rectangular planar shape having a headlap portion and a butt portion. This rectangular shape is defined by a top edge at the upper edge of the headlap portion, a butt edge on the lower edge of the butt portion, a leading edge and a trailing edge, each extending between the top edge and the butt edge. The shingle has at least one slot cutout having a length which extends from the butt edge across the butt portion towards the headlap portion, terminating a predetermined distance from the to edge; a first tab extending longitudinally between the leading edge and the at least one slot cutout; a second tab extending longitudinally between the at least one slot cutout and the trailing edge. The first tab and the second tab are substantially the same length and each tab has a lower edge comprising a portion of the butt edge. The lower edge of each of the first and second tabs includes the improvement comprising an alignment edge which extends a minor portion of the length of this lower edge. The alignment edge is generally straight and parallel to the top edge. The alignment edge of the first tab and the alignment edge of the second tab are spaced the same distance away from the top edge of the shingle. The lower edge of the first tab and the lower edge of the second tab each include a first staggered edge and a second staggered edge. These staggered edges flank the alignment edge of each tab and are angled relative to the top edge and relative to the alignment edge. The staggered edges together with the alignment edges operate to give the butt edge a jagged, nonuniform appearance. A means is located on at least one of said leading edge and said trailing edge for indicating the predetermined distance at the leading edge or the trailing edge. The predetermined distance is substantially equal to the distance from the top edge at which the at least one slot cutout terminates.

In the preferred embodiment, the means on at least one of the leading edge and the trailing edge for indicating the predetermined distance comprises a notch extending along the leading edge and a notch extending along the trailing edge. Both of these notches extend up from the butt edge and terminate at the predetermined distance from the top edge. Preferably, both these notches have a width equal to about one-half the width of the slot cutout.

Hence, in the improved shingle, all locating aids are part of or are located adjacent to the butt portion of each shingle, eliminating the alignment feature necessitated by prior art shingle designs and minimizing the problems caused by such prior art alignment features.

DETAILED DESCRIPTION OF THE INVENTION

Figure 1:
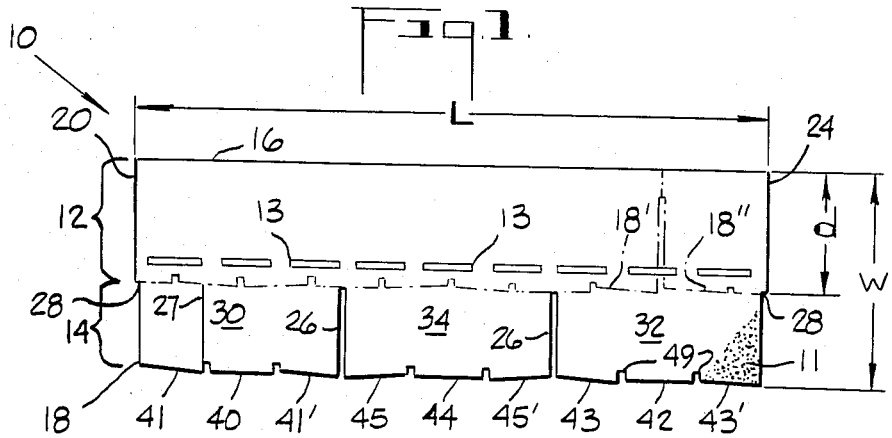
FIG. 1 shows a plan view of the preferred shingle according to the instant invention.

Referring to the Figures wherein like reference numerals refer to like structures throughout the drawings, FIG. 1 shows a rectangular shingle 10 of generally planar shape. The shingle includes a headlap portion 12 and a butt portion 14 extending the full length of the shingle. The overall rectangular shape of the shingle is defined by top edge 16 which runs along the upper edge of headlap portion 12, butt edge 18 which runs along the lower edge of butt portion 14. Leading edge 20 and trailing edge 24 extend between the top edge 16 and butt edge 18 and complete the periphery of the shingle.

The upper surface of shingle 10 is covered with mineral granules 11. This layer of mineral granules extends preferably over both the butt portion and the headlap portion thereof. Another feature of the upper surface of shingle 10 is sealing stripe 13. Sealing stripe 13 is preferably made of a heat sensitive bonding material which operates to adhere to and thus hold down the butt portions of the shingles in the next succeeding course of shingles when the shingle 10 is applied to a roof deck.

It is one goal of the present invention to eliminate the need for any locating or positioning indicia on the headlap portion of the composition shingles. Hence, headlap portion 12 of the instant invention is, except for sealing stripe 13 or other surface features not associated with a positioning function, relatively featureless. In fact, the portions of leading edge 20 and trailing edge 24 which border headlap portion 12 are preferably straight and, for convenience of application as well as the cutting operation used to manufacture such shingle, these portions of edges 20 and 24 are perpendicular to upper edge 16. The overall shape, as stated before, of shingle 10 is rectangular and in the preferred embodiment length L is nominally 36 inches and the overall width W of shingle 10 from upper edge to butt edge 18 is nominally $12\frac{1}{4}$ inches. Width W is divided generally into a headlap d which roughly corresponds with the width of headlap portion 12, and an exposure, which corresponds to the width of exposed butt portion 14. These dimensions, as well as the dividing line between headlap portion 12 and butt portion 14 are only approximately shown in FIG. 1. As terms of art, however, headlap portion and butt portion are reasonably precise even though in FIG. 1 they are not graphically represented with such particularity. The juncture between the headlap portion 12 and the butt portion 14 of shingle 10 would be defined by the outline of the edges of the shingles which would overlap it on a roof deck. FIG. 1 illustrates, for a particular offset alignment, the relationship between the headlap portion, exposed butt portion and the butt edge of the shingles in the next succeeding course. The outline of the overlapping shingles is shown by phantom line 18' and 18''. Phantom line 18' shows the position of the trailing edge and butt edge of one overlapping shingle whose lower edge defines in part the juncture between the headlap portion 12 and exposed portion 14 of shingle 10. Phantom line 18'' shows the position of the abutting leading edge and part of the butt edge of a second overlapping shingle, the lower edge of which defines the remainder of the juncture. The position of this juncture relative to shingle 10 can be different than that shown, depending on the alignment offset chosen. Such different options available with the shingle according to the instant invention will be set forth more fully below. Also, it should be noted that while the precise exposure of butt portion 14 changes from point to point, depending on where the measurement is taken, the phantom lines 18' and 18'' consistently touch or are tangent to the terminal ends of slot cutouts 26 as well as the end of notch 28 on the leading edge 20 and notch 28 on the trailing edge 24. The significance of this relationship will also be more fully set forth below.

Attention is now directed to butt portion 14 and more particularly to butt edge 18, slot cutouts 26 and the detailed relationship between these structures. In general, butt edge 18 has a generally random irregular appearance. However, this edge in the preferred embodiment is highly structured and serves a number of functions. Slot cutouts 26 are positioned at equal intervals across the length L of exposed butt portion 14. Between each slot cutout 26 there is defined a tab. First tab 30 extends longitudinally between leading edge 20 and slot cutout 26. Second tab 32 extends between slot cutout 26 and the trailing edge 28. It is possible to construct a shingle according to Applicant's invention which has only these two tabs. Hence such a shingle, sometimes termed a giant tab shingle since the size of such tabs would be considerably different from the preferred three-tab shingle, would have only a single slot cutout 26. However, Applicant prefers to utilize the benefits of a three-tab shingle construction. Hence shingle 10 includes at least one other tab, namely, center tab 34 extending longitudinally between the two slot cutouts 26 and 26.

Each tab 30, 32 and 34 are substantially the same length. In Applicant's preferred embodiment overall length L is about 36 inches (91.44 cm). Hence each tab is about 12 inches (30.48 cm) in length. Further, each tab has a lower edge corresponding to a portion of butt edge 18.

A minor portion of each lower edge of each tab consists of what is termed an alignment edge shown as 40 on tab 30, 44 on tab 34, and 42 on tab 32. For reasons as will be set forth more fully below, each alignment edge is straight and parallel to top edge 16. Also each alignment edge is spaced the same distance away from top edge 16.

Flanking each alignment edge on each tab are staggered edges. In more detail, tab 30 has a first staggered edge 41 and a second staggered edge 41' flanking alignment edge 40. Tab 32 has a first staggered edge 43 and second staggered edge 43' which also flank alignment edge 42. This general rule also applied to center tab 34, whereat a third staggered edge 45 and fourth staggered edge 45' also flank its alignment edge 44. Applicant has found it desirable to center each alignment edge in the middle of each tab. Also, Applicant has found it desirable to make each alignment edge extend along the lower edges of each tab by a length equal to about one-third of the full length of each tab. A close examination of the various edges of butt edge 18 would reveal a remarkable geometric symmetry, despite the initial visual impression of a jagged nonuniformity. First staggered edges 41 and 43 have the same angular relationship with upper edge 16. Stated another way, the first staggered edges lie along parallel lines. The same relationship applies to second staggered edges 41' and 43', i.e., they form equal angles relative to the top edge. While these angular relationships, unlike the angular relationships between the top edge and the various alignment edges, are not important to the basic operation of the shingle, Applicant has found them an aid in making shingle 10 quite economical to manufacture. These angular relationships permit a pair of shingles 10 to be cut simultaneously from a single strip of shingle material. This fact can be shown by placing a pair of shingles 10 with their butt edges abutting one another and the leading edge of one and the trailing edge of the other in substantial colinear relationship. Thus positioned, it will be seen that the first staggered edge of one first tab 30 will be tangent to second staggered edge of second tab 32 with both upper edges 16 of the pair of shingles 10 being parallel. Basic geometry tells us that a line (or in this case a segment of a line) representing the juxtaposed first and second staggered edges forming an angle with one of those parallel lines (representing edges 16) forms the same angle with the other of those parallel lines. This geometric relationship is repeated throughout each of the first and second staggered edges.

Turning now to center tab 34 it should be noted that staggered edge 45 and staggered edge 45' are not only at an angle relative to upper edge 16 (since by definition they are staggered edges) but are also angled relative to the first staggered edges 41 and 43 and second staggered edges 41' and 43'. Applicant has found such angled relationship desirable in order to further enhance the jagged, nonuniform appearance of the shingle as a whole. In passing it is noted that third staggered edge 45 and fourth staggered edge 45' form equal angles relative to upper edge 16. Remembering how the first staggered edge 41 and second staggered edge 43' tend to have equal angles relative to upper edge 16, the reason for third staggered edge 45 and fourth staggered edge 45' having a similar angular relationship becomes apparent.

It is possible and perhaps desirable in certain situations to have other angular relationships among various staggered edges, yet still maintain the economic advantage of defining the butt edges of paired shingles 10 with the same cut. However, with the angular relationships disclosed, a plurality of shingles 10 may be stacked one on top of the other in standard bundles with each edge making up butt edge 18 reinforcing its corresponding edge in each shingle in the bundle. This is desirable since the jagged nonuniform appearance relies in part on the crisply defined corners at the junctures of each staggered edge and each alignment edge. If all the shingles were not identical (which could be the case by cutting pairs of shingles offset from one another or in a completely different operation) there would be less structural reinforcement of each staggered edge and hence a greater chance for distorting the corners of such edges.

Figure 2:
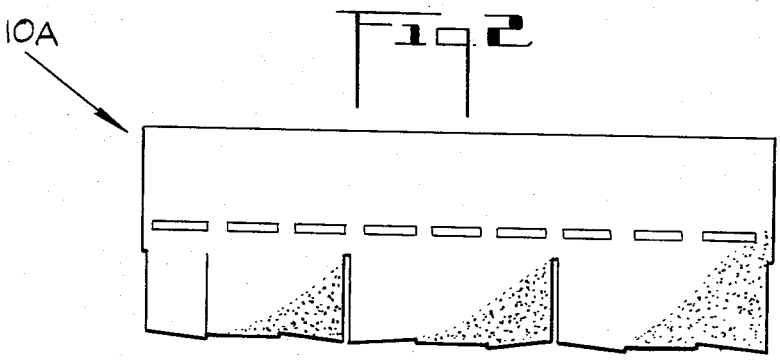
FIG. 2 shows a view similar to FIG. 1 showing a different form of the shingle according to the instant invention.

An optional feature shown in FIG. 1 is the relatively small cutout 49. These small cutouts 49 extend a minor fraction of the distance between butt edge 18 towards headlap portion 12. They are defined between each staggered edge and each alignment edge. Such cutouts 49 further enhance the jagged nonuniform appearance but require a certain amount of the composition shingle material to be removed, creating a scrap problem which perhaps would not justify the added aesthetic appeal of such cutouts 49. FIG. 2 shows a substantially identical shingle 10*a* to that shingle 10 shown in FIG. 1 without the small cutouts 49.

Shingle 10 further includes knife slit 27 just to the right of first staggered edge 41. The benefit of knife slit 27 will be fully set forth below with particular reference to FIG. 4.

Figure 3:
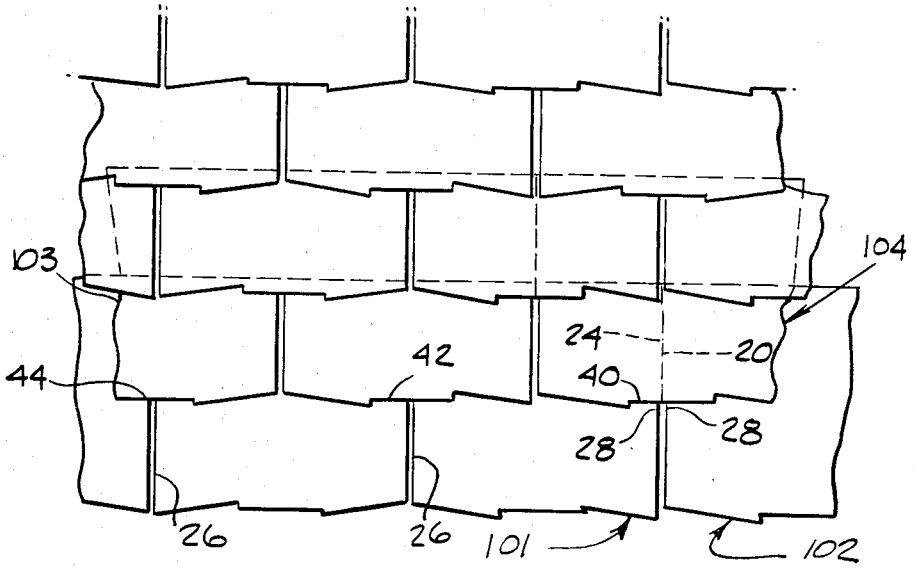
FIG. 3 shows an application of a plurality of shingles according to the instant invention.

Attention is now directed to FIG. 3 which shows a plurality of shingles similar to 10*a* of FIG. 2. These plurality of shingles are shown in operative relation with one another as they would be in typical installation on a roof deck. Particular attention is now directed to the lower portion of FIG. 3 which shows right portion of shingle 101 according to the instant invention and a left portion of shingle 102 in the same course immediately next to shingle 101. Notch 28 located on trailing edge 24 of shingle 101 is directly adjacent notch 28 in leading edge 20 of shingle 102. The upper end of each notch 28 and 28 can be easily located opposite one another as can the upper edge of each of the respective shingles. These two features combine to aid in positioning shingle 102 next to 101 during application of the shingles. Also, notches 28 and 28 combine to form a gap between the respective tab portions which is substantially identical to slot cutouts 26, especially when the immediately succeeding course of shingles is placed over the juncture extending above the slots 28. While having a notch 28 on both leading edge 20 and trailing edge 24 is preferred, a single notch having a width equivalent to that of slot coutouts 26, positioned on the trailing edge (such as that shown in U.S. Pat. No. 2,348,223) would function adequately. In such case the upper edges of the shingles can be aligned, or a chalk line used to keep the courses linear.

As set forth supra, the upper end of slots 28 is located the same distance from the upper edge of the shingle as is the terminating end of each of slots 26. Hence, in the course of shingles typified by shingles 101 and 102 there is located a series of indicia that the installer can be sure represents a uniform distance from the upper edges of these shingles, these indicia being the terminal ends of 26 and juxtaposed notches 28. Turning attention to shingles 103 and 104 in the next course of shingles, the importance of this feature becomes apparent. When shingle 103 is positioned for nailing, the installer need only position alignment edges (of which alignment edges 44 and 42 are shown) above the upper end or termination of any of the slots 26 or juxtaposed notches 28 and 28 in the just preceding course. With these positive positioning indicia being available and effective, there is no need for the upper straight portions of leading and trailing edges 24 and 20 to include locating indicia (such as protrusions, cutouts, etc.) to locate the overlapping shingle relative to the upper edge of any of the preceding shingles. When shingle 104 is positioned for fastening, the applicator need only align the alignment edges (of which alignment edge 40 is shown) against the terminating or upper end of any of slots 26 or slot simulating notches 28 and 28 in the same manner as the butt edge and cutouts are aligned when installing a standard three-tab shingle. There is no need for locating indicia (such as generally required on a strip shingle) to be positioned (or improperly positioned) relative to one another on the touching leading and trailing edges of 103 and 104 for example.

The operation of the preferred form of Applicant's shingles when positioned with other similar shingles having been explained, other benefits of Applicant's invention become apparent. The choice of the length of locating edges 40, 42, etc. relative to the width of the tab makes it possible for offset alignment other than the one depicted in FIG. 3 to be easily effected. For example the applicator, rather than choosing to position each slot or each simulated slot in the center of each locating edge, could choose a location to the extreme right or extreme left of the locating edges. Proper exposure distance is assured in any of these positions, or any intermediate position for that matter, since each locating edge is parallel to the upper edge of the respective shingles. Applicant has found that by making the length of each locating edge equal to about one-third the width of each tab, virtually all standard alignment offsets can be achieved without compromising to any great extent the jagged nonuniform appearance of the butt edge of the shingle. In Applicant's preferred embodiment in which the overall shingle length is 36 (91.44 cm) inches and each tab is about 12 (30.48 cm) inches long, each locating edge is hence about 4 (10.16 cm) inches long.

Figure 4:
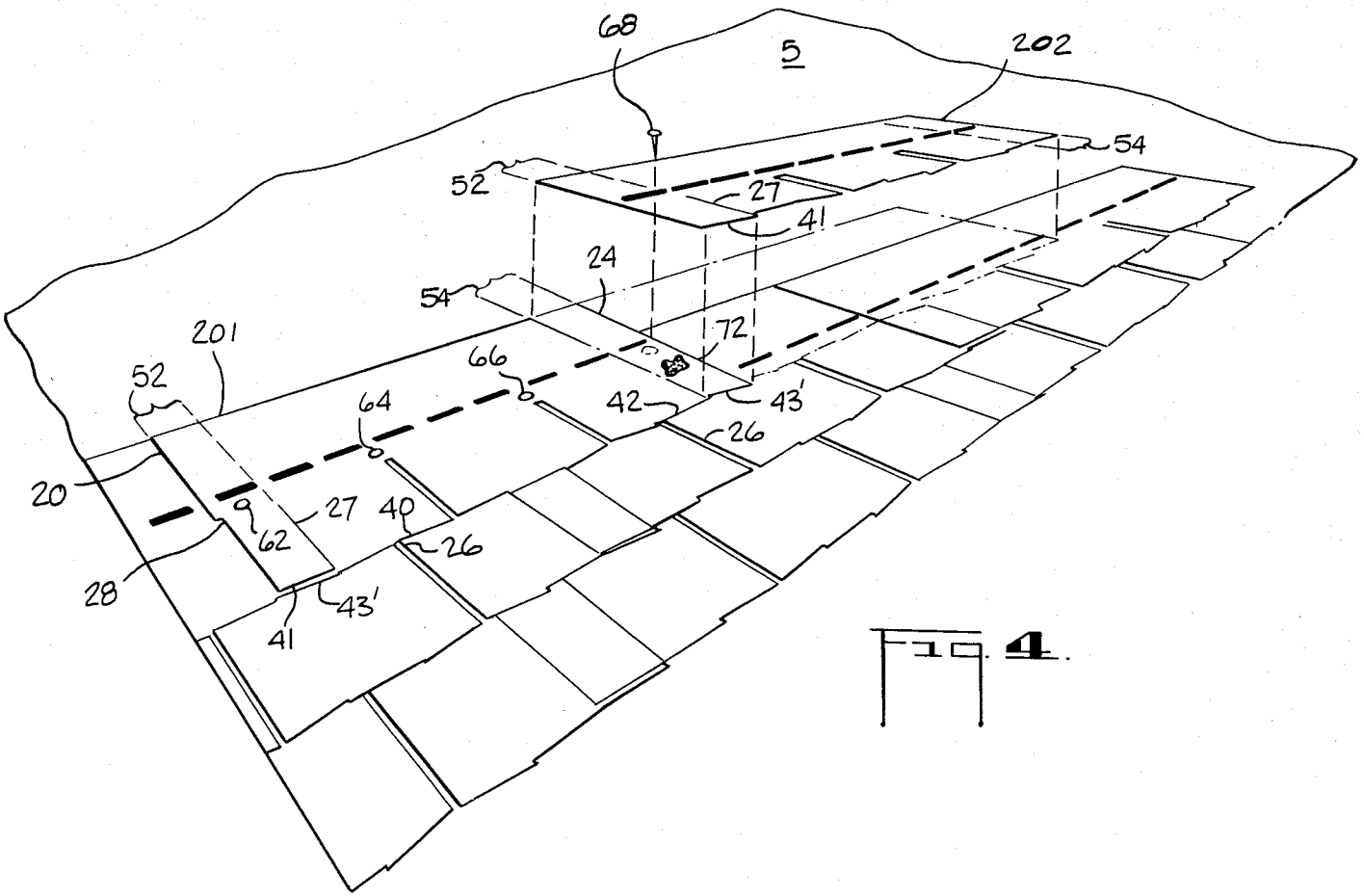
FIG. 4 shows an alternate application of a plurality of shingles according to the instant invention.

FIG. 4 shows another method for applying the staggered butt edge shingles to a roof deck 5. Here the knife slit 27 becomes significant. As illustrated herein, knife slit 27 defines, in conjunction with leading edge 20 and first staggered edge feature 41 when used in the to-be-described application method, an overlap tab portion 52. Along the trailing edge 24 of each shingle is defined a corresponding underlap portion 54. Underlap portion 54 is bordered by trailing edge 24 and second staggered edge feature 43'. In the preferred embodiment, the shape of underlap portion 54 and overlap tab 52 are substantially identical since when applied overlap tab 52 completely covers underlap portion 54. Also, since staggered edge feature 41 and staggered edge feature 43' have equuivalent contours and preferably are spaced an equivalent distance from upper edge 16 of each shingle, these staggered edge portions form a double thick edge when overlapped as shown in FIG. 4. This double thick edge not only adds to the aesthetic aspects of a roof covered as disclosed, but also acts as another alignment feature. While slot cutouts 26 and the various alignment edges 40, 42 and 44 continue to function as alignment aids, the vertically aligned staggered edges 41 and 43' contribute to the overall alignment ease of the disclosed shingle. The application method shown in FIG. 4 obviously requires a greater number of shingles to cover a given roof deck 5 as compared to the application of the same shingle shown in FIG. 3. However, two benefits provided by the overlap application of FIG. 4 outweigh in some instances this disadvantage. The first is primarily an aesthetic benefit which enhances the overall visual impression imparted by the jagged and irregularly appearing butt edge 18 of the shingles. When such shingles are applied as in FIG. 4 a series of double thick overlap tabs are created. When a series of courses of such overlapping shingles are applied to a roof deck in such a manner that any vertical pattern created by these double thick portions is disrupted, the overall rustic appearance of the roof covering can be quite effective. The overall effect can be compared quite favorably to the more expensive laminated shingles. Such laminated shingles are composed of an overlay portion and an underlay portion which together each shingle creates single thick and double thick butt portions. In the instant invention the double thick portions are created at intervals along each course of shingles by the overlap of each shingle by a succeeding shingle.

The instant inventive method incorporates a considerable savings in material and labor by requiring only three-shingle fasteners, either roofing nails or roofing staples, for each shingle used to cover the roof deck 5. This three nail per shingle ratio is to be compared with the usual four nail per shingle ratio of ordinary three-tab shingle application. This four nail per shingle ratio applies whether such shingles are applied in a leading edge to trailing edge configuration such as illustrated by FIG. 3 or in an overlapping shingle situation as illustrated in U.S. Pat. No. 3,919,823 discussed supra. The actual sequence of positioning and fastening will be set forth in greater detal with reference to FIG. 4.

Shingle 201 in the course of shingles being installed has three nails 62, 64 and 66 already in place in the headlap portion thereof. Nail 62 constitutes the sole roofing fastener passing through the overlap tab 52 of shingle 201 and the underlap portion of the just preceding shingle. Nail 64 and nail 66 are positioned approximately $\frac{5}{8}$ inch above the slot cutout in the body of shingle 201, these positions being consistent with normal three-tab shingle practice. Note however that underlap portion 54 of shingle 201 has yet to have a shingle fastener pass therethrough since all other fasteners (fasteners 62, 64 and 66) pass through a part of the headlap portion which excludes that part constituting the underlap portion 54. In the sequence of events which follow, second shingle 202 is positioned such that overlap tab 52 overlaps the underlap portion 54 of the first shingle 201. As was done in the application of shingle 201, shingle 202 has the alignment edges of the butt edge thereof positioned such that they correspond to the terminal end of the slot cutouts of the underlying shingles. Also, as staggered edges 41 and 43' are the same distance from the upper edge of their respective shingles, these edges also are aligned with one another. Once positioned as set forth above, the second shingle 202 is fastened to the roof deck by in part passing roofing nail 68 through overlap tab 52 and the underlaying underlap portion 54. Additional roofing fasteners are passed through the headlap portion of second shingle 202 in the part thereof excluding the underlap portion 54 thereof.

The above sequence is repeated to cover roof deck 5. Normal nailing is required even in the inventive method along the ridges and perhaps valleys and rakes of a roof system in which roof deck 5 is a part. Despite this, there is still a savings of approximately 15% in fastener use and fastener operation over the usual four nail per shingle method. While approximately $12\frac{1}{2}$% more material is used in the basic overlap tab application, it is not a direct tradeoff, since increased aesthetic aspect alone can justify the increase in material usage. It should be pointed out that a spot roofing adhesive such as spot 72 may be required in certain situations to hold down the butt portion of overlap tab 52 and prevent wind blowoff of this portion. Roofing adhesive spot 72 is, however, not necessarily to assure weather integrity of the roof covering made thereby, since its function is primarily aesthetic in nature. However, to maintain the overall aesthetic appearance, spot 72 is desirable. The addition of spot 72 should not be considered as necessitated by the use of only three fasteners for each roof shingle since such a spot would be required to the same extent and for the same purposes even if more than one roof fastener were passed through underlap portion 54 of each shingle.

In summary, Applicant's inventive concept provides a shingle which has distinctive aesthetic appeal, yet provides a roof covering which is both easily applied and of dependable weather tightness. The shingle according to the instant invention does not depend on locating notches or protrusions in the upper portions of the abutting leading and trailing edges to assure uniform exposure. Nor does Applicant's preferred shingle have the aesthetic limitations to which a standard three-tab shingle has heretofore been restricted.

I claim:

1. In a shingle of generally rectangular planar shape having a headlap portion and a butt portion, said rectangular shape being defined by a top edge at the upper edge of the headlap portion, a butt edge on the lower edge of said butt portion, a leading edge and a trailing edge each extending between said top edge and said butt edge, at least two slot cutouts each having a length which extends from said butt edge across said butt portion towards said headlap portion and terminating a predetermined distance from said top edge, means located on at least one of said leading edge and said trailing edge for indicating said predetermined distance, a first tab extending longitudinally between said leading edge and one of said slot cutouts, a second tab extending longitudinally between said one slot cutout and said trailing edge, said first tab and said second tab being substantially the same length and each tab having a lower edge corresponding to a portion of said butt edge, the improvement comprising:

(a) an alignment edge extending a minor portion of the length of said lower edge of each of said first tab and said second tab for aligning with the terminal end of a slot cutout or an indicating means of a substantially identical subjacent shingle, said alignment edge being generally straight, parallel to and spaced the same distance away from said top edge of the shingle;

(b) the lower edge of said first tab and the lower edge of said second tab each further including a first staggered edge and a second staggered edge, said staggered edges flanking said alignment edge and being angled relative to said top edge and said alignment edge, whereby said staggered edges together with said alignment edges operate to give said butt edge a jagged, non-uniform appearance;

(c) a center tab extending longitudinally between said two slot cutouts and said first tab and said second tab, said center tab having a lower edge corresponding to a portion of said butt edge and including an alignment edge extending a minor part of the length of said lower edge, said alignment edge being straight and parallel to said top edge and being spaced from said top edge the same distance as the alignment edge of said first tab and said alignment edge of said second tab;

(d) Said center tab further including a third staggered edge and a fourth staggered edge, said third and fourth staggered edges flanking said alignment edge and being angled relative to said top edge and to said alignment edges, both said third and said fourth staggered edges being angled relative to said first staggered edge and said second staggered edge of each said first and second tabs.

2. A shingle as set forth in claim 1 wherein said leading edge is straight and perpendicular relative to said top edge at least for a distance extending from said top edge to said butt portion.

3. A shingle as set forth in claim 2 wherein said trailing edge is straight and perpendicular to said top edge at least along a distance extending from said top edge to said butt portion.

4. A shingle as set forth in claim 1 wherein said means at at least one of said leading edge and said trailing edge for indicating said predetermined distance comprises a notch extending along said leading edge and a notch extending along said trailing edge, both said notches extending from said butt edge and terminating at said predetermined distance from said top edge, said notch having a width equal to about one-half the width of said at least one slot cutout.

5. A shingle as set forth in claim 1 wherein said first staggered edge of said first tab and said second staggered edge of said second tab form equal angles relative to said top edge;

said second staggered edge of said first tab and said first staggered edge of said second tab form equal angles relative to said top edge.

6. A shingle as set forth in claim 1 wherein each said alignment edges extend along said lower edges of each said tabs a length equal to about one-third the length of each said tabs.

7. A shingle as set forth in claim 1 wherein relatively small slot cutouts extending a minor fraction of the distance between said butt edge and said headlap portion are provided between each said staggered edge and each said alignment edge.

8. In a shingle of generally rectangular planar shape having a headlap portion and a butt portion, said rectangular shape being defined by a top edge at the upper edge of the headlap portion, a butt edge on the lower edge of said butt portion, a leading edge and a trailing edge each extending between said top edge and said butt edge, at least one slot cutout having a length which extends from said butt edge across said butt portion towards said headlap portion and terminating a predetermined distance from said top edge, means located on at least one of said leading edge and said trailing edge for indicating said predetermined distance, a first tab extending longitudinally between said leading edge and said at least one slot cutout, and at least one other tab positioned between said at least one slot cutout and said trailing edge, said first tab and said at least one other tab being substantially the same length and each tab having a lower edge corresponding to a portion of said butt edge, the improvement comprising:

(a) an alignment edge extending a minor portion of the length of said lower edge of said first tab for aligning with the terminal end of a slot cutout or an indicating means of a substantially identical subjacent shingle, said alignment edge being generally straight, parallel to and spaced the same distance away from said top edge of the shingle;

(b) the lower edge of said first tab further including a first staggered edge and a second staggered edge, said staggered edges flanking said alignment edge and being applied relative to said top edge and said alignment edge;

(c) said other tab having a lower edge corresponding to a portion of said butt edge and including an alignment edge extending a minor part of the length of said lower edge, said alignment edge being straight and parallel to said top edge and being spaced from said top edge the same distance as the alignment edge of said first tab, a third staggered edge and a fourth staggered edge, said third and fourth staggered edges flanking said alignment edge and being angled relative to said top edge and to said alignment edges, and also angled relative to said first staggered edge and said second staggered edge of said first tab.

* * * * *

UNITED STATES PATENT AND TRADEMARK OFFICE

CERTIFICATE OF CORRECTION

PATENT NO. : 4,527,374

DATED : Jul. 9, 1985

INVENTOR(S) : Raymond L. R. Corbin

It is certified that error appears in the above—identified patent and that said Letters Patent is hereby corrected as shown below:

Column 11, line 2, after "at" first occurance
insert --said--.

Column 12, line 20, "applied" should read
--angled--.

Signed and Sealed this

*Twelfth* Day of *November 1985*

[SEAL]

*Attest:*

DONALD J. QUIGG

*Attesting Officer*

*Commissioner of Patents and Trademarks*